US010786065B2

(12) United States Patent
Seguin et al.

(10) Patent No.: US 10,786,065 B2
(45) Date of Patent: Sep. 29, 2020

(54) INTERACTIVE CASING FOR A COSMETIC PRODUCT, IN PARTICULAR FOR MAKE-UP

(71) Applicant: ALBEA SERVICES, Gennevilliers (FR)

(72) Inventors: Franck Seguin, Auvers-sur-Oise (FR); Melodie Bazinval, Deuil-la-Barre (FR); Emir Ezzina, Montigny (FR); Etienne Briere, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 16/288,027

(22) Filed: Feb. 27, 2019

(65) Prior Publication Data

US 2019/0261763 A1 Aug. 29, 2019

(30) Foreign Application Priority Data

Feb. 27, 2018 (FR) ..... 18 51719

(51) Int. Cl.

| | |
|---|---|
| ***H04B 1/38*** | (2015.01) |
| ***A45D 40/18*** | (2006.01) |
| ***A45C 11/00*** | (2006.01) |
| ***A45D 40/22*** | (2006.01) |
| ***A45D 40/24*** | (2006.01) |
| ***A45D 44/00*** | (2006.01) |
| ***A45D 33/26*** | (2006.01) |

(52) U.S. Cl.

CPC ..... *A45D 40/18* (2013.01); *A45C 11/008* (2013.01); *A45D 33/26* (2013.01); *A45D 40/22* (2013.01); *A45D 40/24* (2013.01); *A45D 44/005* (2013.01); *A45C 2011/002* (2013.01); *A45D 2044/007* (2013.01)

(58) Field of Classification Search

CPC ..... A45D 40/18; A45D 33/26; A45D 40/22; A45D 40/24; A45D 44/005; H04W 4/80; H04M 1/0206; H04M 1/0214

See application file for complete search history.

(56) References Cited

U.S. PATENT DOCUMENTS

| | | | | |
|---|---|---|---|---|
| 2003/0041871 | A1 | 3/2003 | Endo et al. | |
| 2004/0246667 | A1* | 12/2004 | Maskatia | G06F 1/1618 361/679.28 |
| 2012/0273385 | A1* | 11/2012 | Lim | A45C 11/008 206/581 |

(Continued)

FOREIGN PATENT DOCUMENTS

| | | |
|---|---|---|
| WO | WO2017090914 | 6/2017 |

*Primary Examiner* — Tuan Pham

(74) *Attorney, Agent, or Firm* — Steven M. Greenberg, Esq.; Shutts & Bowen LLP

(57) ABSTRACT

A casing for a cosmetic product includes at least one base and a cover which are movably mounted with respect to each other between at least one closed position and an open position of the casing in which means for supporting at least one cosmetic product are accessible. The cover is configured to receive at least display means. The base includes at least one housing with the support means. The casing includes a device for processing data of the contactless type that is at least capable of reading one or more items of data contained in at least one data support integral with the means for supporting when the support means are mounted in the at least one housing.

8 Claims, 5 Drawing Sheets

(56) References Cited

U.S. PATENT DOCUMENTS

| | | | | |
|---|---|---|---|---|
| 2014/0299151 | A1* | 10/2014 | Stroud | A45D 33/008 132/315 |
| 2015/0257502 | A1* | 9/2015 | Ziemba | A45C 1/04 206/235 |
| 2017/0024589 | A1* | 1/2017 | Schumacher | G06F 3/0481 |
| 2017/0270774 | A1 | 9/2017 | Fateh et al. | |
| 2018/0018482 | A1 | 1/2018 | Jammet | |

* cited by examiner

INTERACTIVE CASING FOR A COSMETIC PRODUCT, IN PARTICULAR FOR MAKE-UP

CROSS REFERENCE TO RELATED APPLICATIONS

This application claims priority under 35 U.S.C. § 119(a) to French Patent Application Serial Number 1851719, filed Feb. 27, 2018, the entire teachings of which are incorporated herein by reference

BACKGROUND OF THE INVENTION

Field of the Invention

The invention relates to an interactive casing for a cosmetic product, in particular for make-up.

Description of the Related Art

Numerous examples of casings used for the packaging of cosmetic product(s) are known from prior art, in particular but not exclusively make-up products. Such a casing, also sometimes called "compact" can have dimensions and shapes that are highly varied (round, parallelepiped, etc.), in particular according to the type of cosmetic product(s) packaged in the casing. The casing is generally intended to be able to be transported easily, giving it the name of "compact" thereof, by ensuring the protection of the cosmetic products contained inside the casing. Casings are in particular used to package make-up products such as blushers, powders or other similar products used to embellish the face.

Numerous casings thus include a mirror housed inside the cover, as well as sometimes a product applicator such as a sponge, a brush, etc. New casing designs are sought today that make it possible in particular to offer users new services, especially in relation with the packaged cosmetic product or products.

BRIEF SUMMARY OF THE INVENTION

For this purpose, the invention proposes a casing for a cosmetic product including at least one base and a cover which are movably mounted with respect to each other between at least one closed position and an open position of the casing wherein means for supporting at least one cosmetic product are accessible, the casing being characterized in that the cover is configured to receive at least display means, the base includes at least one housing intended to include the means for supporting, and in that the casing includes a device for processing data of the contactless type that is at least capable of reading one or more items of data contained in at least one data support integral with the means for supporting when the means for supporting are mounted in the at least one housing.

Advantageously, the display means of the electronic type are capable of delivering information in relation with the item or items of data contained in the at least one data support which is associated with the means for supporting of the cosmetic product or products.

As the means for supporting the at least one cosmetic product are advantageously removable and being as such interchangeable, the casing is consequently able to receive various means for supporting, forming for example a refill which offers the user the possibility to change this at will and with complete freedom.

Such a change in the support means can, for example, be motivated by the desire to change the type and/or the color of the cosmetic product or products or the need to refill the casing after the complete use of the or of at least one of the cosmetic products.

Thanks to the at least one data support which is integral with the support means, the support means are likely to carry onboard an item or items of data concerning, for example, information in relation with the cosmetic product or products contained in the support means.

For each new support means mounted in the position of use in the base of the casing, it is thus possible to selectively deliver, after the reading of the item or items of data contained in the at least one data support, information to the user.

Such information can, in particular but not exclusively, be based on the cosmetic product or products, recommendations for use, etc. or consist of proposing associated services.

Advantageously, the information or services are delivered to the user by way of the display means that the cover of the casing includes.

Advantageously, the display means are formed by at least one screen which is preferably touch-sensitive such as the one of a mobile telephone of the "smartphone" type.

Advantageously, the display means include, for example, an application likely to make use of one or more items of data contained in the data support, which is preferably formed by an NFC tag, in order to deliver information and/or services to the user.

Such an interactive casing offers new possibilities and multiple advantages and this for the users as well as for the manufacturers and/or the sellers of cosmetic products.

Thanks to the casing according to the invention, it is furthermore possible to deliver to the user multiple items of information, in particular on the use of the cosmetic product or products, on new products or trends (latest innovations of a brand, etc.), to propose a selection of products according in particular to the cosmetic products used in the casing and/or personal characteristics (colour of the eyes, of the skin, etc.) of the user.

By way of the screen and an application such as a tutorial, it is for example possible to deliver recommendations for choosing from a range of different cosmetic products one or more products that are in line with the identified needs of the user, recommendations for applying the product or products.

Advantageously, the interactive casing includes means for communicating which are able to exchange data, in particular by the intermediary of a wireless connection, for example a Wi-Fi connection, thanks to which the casing itself is able to connect to a network such as the internet.

Preferably, such communication means are incorporated into the display means formed by at least one screen.

Advantageously, the interactive casing according to the invention includes a mobile telephone of the smartphone type of which the touch-sensitive screen forms the display means and which is likely to perform many other functions such as the aforementioned one of exchanging data by way of a wireless connection and more specifically, with the internet.

Advantageously, when the casing includes a camera associated with the screen, it is thus possible for the user to take self-portraits (or "selfies") in particular after having applied make-up with at least one product and to then share the experience thereof on the internet, for example on "social" networks.

When the casing includes a mobile telephone, it then offers the same functions, such as for example the possibility for the user of placing orders for cosmetic products via the internet by using the touch-sensitive screen and this, for the purpose of having delivered directly an order of cosmetic products to the location of their choice, such as their home.

Advantageously, the casing includes a cover which is configured to receive display means and more particularly a device such as a mobile telephone.

Preferably, the mobile telephone can be removed with respect to the cover of the casing thanks to which it is possible for the user to associate therewith their personal mobile telephone.

Indeed, the casing can be provided without display means when the cover is configured to receive a device such as a mobile telephone.

The mobile telephone has today become an essential device of daily use which is used at every moment and by way of which an increasing amount of services are proposed.

Advantageously, the casing also offers many advantages for a brand of cosmetic products by giving it the possibility of establishing better contact with the users of the products thereof, which serves to reinforce their loyalty to the brand.

The use of the casing in relation with the internet is likely to offer an increased awareness of the brand for other users, in particular through the exchanging of information between users over the social networks.

The interactive casing is also able to make it possible to better understand the needs of users by delivering information that can be analysed by a brand in order to improve all of the services offered, from the sale, to manufacturing, the management of cosmetic product inventories.

For this purpose, the invention also proposes means for supporting at least one cosmetic product for a casing according to the invention, characterised in that the means for supporting include at least one data support.

The support means include at least one data support at least able to be read by a device for processing data integrated into the casing, the at least one data support being preferably formed by a tag of the NFC type.

Advantageously, support means are proposed including at least one cosmetic product so as to offer a refill intended for such a casing thanks to which the casing is not limited to a single use.

According to other characteristics of the invention:

- the support means including the at least one data support are removable;
- the casing includes means for assisting with the extraction in order to facilitate the removal of the interchangeable support means outside of the housing;
- the device for processing data includes at least one first portion which is arranged in the base and a second portion which is arranged in the cover, the first and second portions being electrically connected by at least one ribbon connector;
- the casing being of the type wherein hinging means are arranged between the cover and the base in order to form a hinge so as to be able to move them between the closed and open positions, the hinging means are configured to have a passage intended for the ribbon connector connecting the first portion and the second portion of the device for processing data;
- the first portion of the device for processing data is capable of communicating with the at least one data support that is contained in the support means and the second portion of the device for processing data is able to communicate with at least the display means;
- the at least one data support is a tag of the NFC type;
- the casing includes display means which are constantly integral with the cover or removable with respect to the cover;
- the display means include at least one screen belonging to an electronic device, in particular to a mobile telephone.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Below in the description, the longitudinal, vertical and transversal orientations in reference to the trihedron (L, V, T) will be adopted in a non-limiting manner, shown in the figures.

Conventionally, the longitudinal and transversal orientations are determined in a fixed manner with respect to the base of the casing such that the open or closed position of the cover of the casing has no impact on the longitudinal or transverse orientations.

Use shall also be made in a non-limiting manner of the terms "upper" and "lower" in reference to the vertical orientation of the trihedron (L, V, T). In addition, the terms "inner or inside" and "outer or outside" are respectively used with respect to the casing and generally to designate an element located either inside, or on the outside of the casing.

Again conventionally, the terms "front" and "rear" are used in reference to the longitudinal orientation of the trihedron (L, V, T), with the casing opening via a rotation of the cover from the front towards the rear about the axis O of rotation determined by the hinging means arranged at the rear of the casing and the terms "left" and "right" are used in reference to the transversal orientation of the trihedron (L, V, T).

Figure 1:
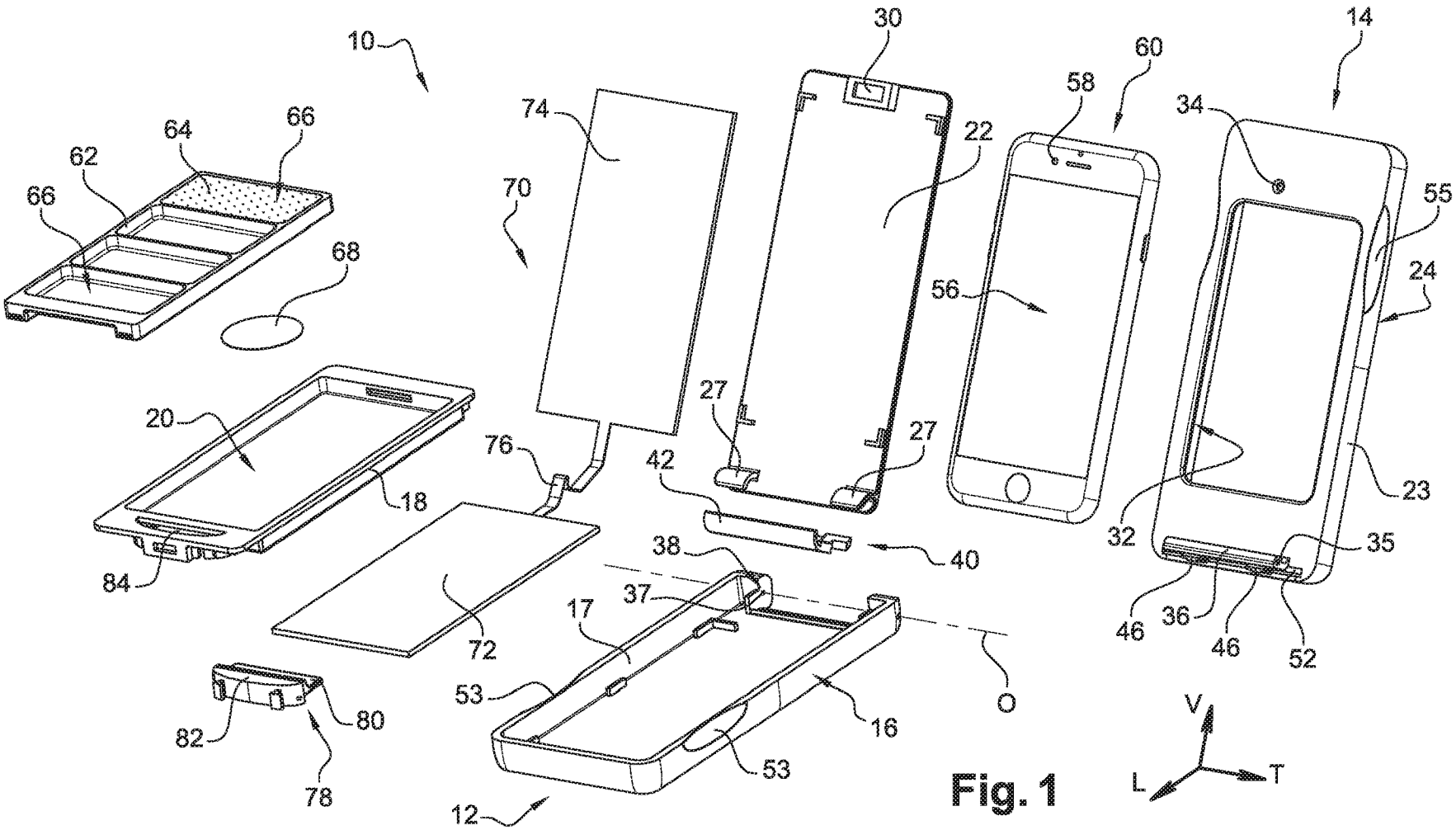
FIG. 1 is a perspective view that shows an exploded view of an embodiment of a casing for a cosmetic product according to the invention and which shows the main parts of it.

FIG. 1 shows an example of a casing 10 for a cosmetic product carried out in accordance with the teachings of the invention.

According to the example of FIG. 1, the casing 10 has, in a non-limiting manner, a generally parallelepiped shape.

Figure 5:
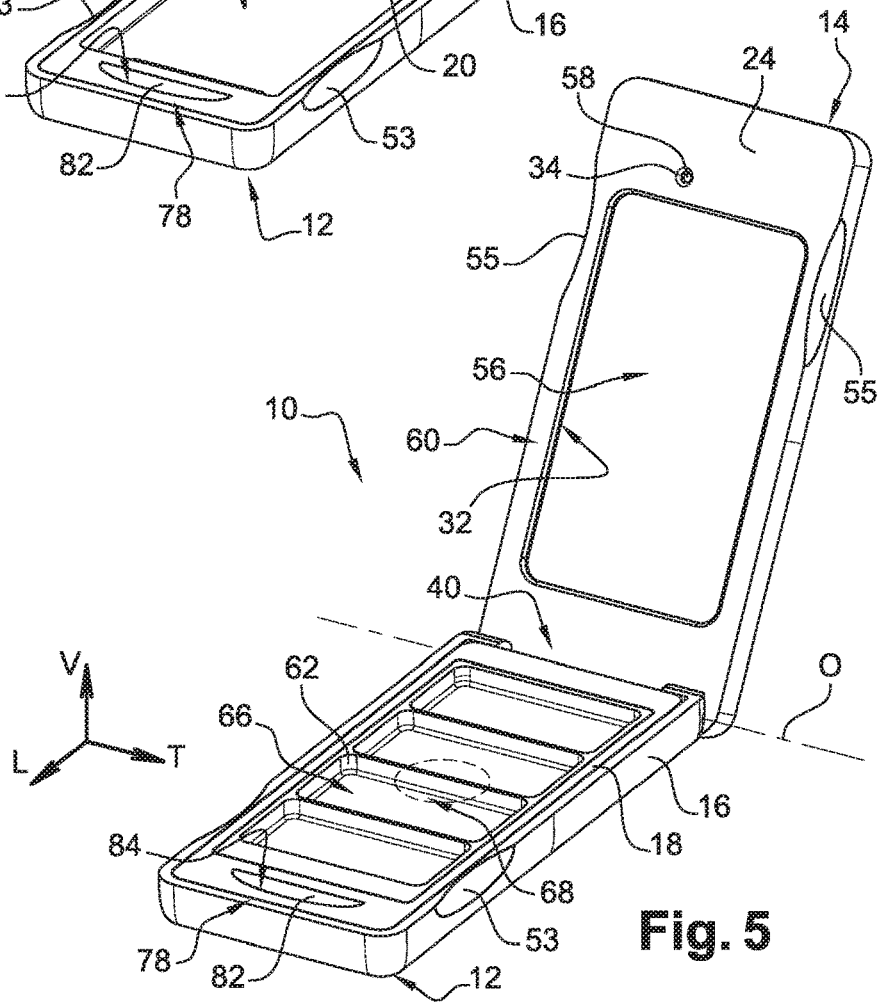
FIG. 5 is a perspective view, similar to FIG. 4, that shows the casing in the open position and which shows the means for supporting at least one cosmetic product in the position of use, after the mounting thereof inside the housing of the base.

The casing 10 for a cosmetic product includes at least one base 12 and one cover 14 which are movably mounted with respect to each other between at least one closed position (FIG. 2) and an open position (FIG. 5).

The closed position of the casing corresponds to a position wherein the cosmetic product or products contained in the casing are protected, in particular for the purpose of the transport thereof.

The open position corresponds to a position wherein the cosmetic product or products are made accessible, in particular for the purpose of the use thereof.

Preferably, the base 12 is made of two parts, respectively an outer part 16 and an inner part 18.

The outer part 16 of the base 12 has a general shell shape delimited on the perimeter thereof by an edge 17. The inner part 18 is intended to be mounted inside the outer part 16.

Advantageously, such a production in two parts 16, 18 of the base 12 makes it possible to freely select the materials of each one of the parts.

The outer part 16 here forms the bottom of the casing 10, the part 16 being, for example, likely to be made from a material that has an aesthetic aspect or coated with a layer in order to give it a specific finish, in particular of the metallised type.

The inner part 18 includes at least one housing 20.

Preferably, the cover 14 is made from two parts, respectively an outer part 22 and an inner part 24.

Figure 2:
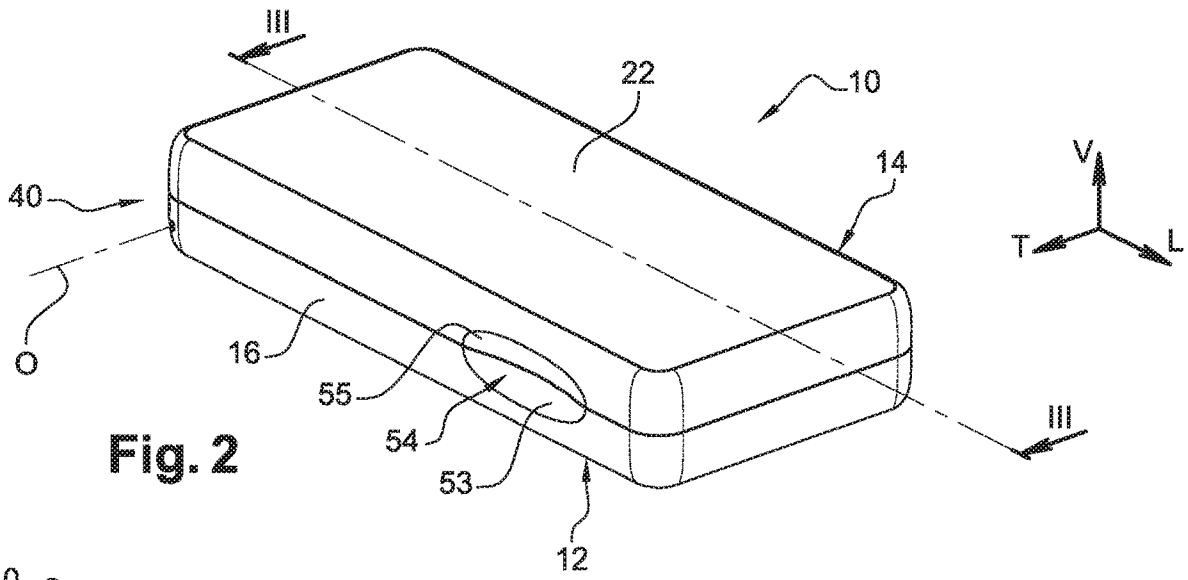
FIG. 2 is a perspective view that shows the casing according to FIG. 1 and which shows the casing in the closed position.

The outer part 22 of the cover 14 here has the shape of a plate that forms the top of the casing 10, in particular visible when the casing 10 is in the closed position such as shown in FIG. 2.

The inner part 24 has the general shape of a shell delimited on the perimeter thereof by an edge 23.

After assembly, the outer part 22 and the inner part 24 together delimit an inner cavity 26.

Advantageously, the outer part 22 and the inner part 24 are mounted articulated with respect to one another by way of the hinging means 28.

In the embodiment example, the hinging means 28 include a pair of arms 27 which, integral with the outer part 22, are intended to cooperate with two lugs 29 integral with the inner part 24.

Preferably, the arms 27 and the lugs 29 form the hinging means 28 by pivoting and are respectively arranged opposite one another according to the transversal direction so as to leave centrally a clearance, a free space between them.

The means 28 for hinging between the outer part 22 and the inner part 24 here are arranged on the end of the cover 14 which is intended to be connected to the base 12.

Alternatively, the hinging means 28 are arranged between two other edges of the parts 22 and 24, for example, so as to have a pivot axis perpendicular to an axis O of rotation of the casing that will be described later.

Advantageously, the cover 14 includes fastening means 30 intended to fasten together, reversibly, the outer part 22 and the inner part 24.

Preferably, the fastening means 30 are arranged opposite the hinging means 28, here at the other end of the cover 14.

The fastening means 30 are, for example, formed by magnets or means of complementary shape cooperating together, by friction or by elastic nesting, or formed by any other equivalent means.

Thanks to the hinging means 28, the outer part 22 and the inner part 24 are mounted mobile between a closed position and an open position.

Advantageously, it is possible to temporarily separate the outer part 22 with respect to the inner part 24, in particular to make them ajar, so as to make it possible for access to the inner cavity 26 arranged in the cover 14.

The inner part 24 includes a window 32, here of rectangular shape. In addition, the inner part 24 includes an opening 34, here of circular shape.

The casing 10 includes hinging means 40 that are arranged between the cover 14 and the base 12 so as to form a hinge.

Advantageously, the hinging means 40 make it possible to move the cover 14 and the base 12 relatively with respect to one another between the closed and open positions of the casing.

The hinging means 40 include a first mobile portion 36 which is centrally mounted between a second fixed portion 38, the first portion 36 and second portion 38 being intended to be connected transversally by a pin (not shown) to form the hinge.

In a manner known per se, the pin is for example formed by a metal rod which is transversally inserted through at least one bore 35 of the first mobile portion 36 and a bore 37 of the second fixed portion 38.

The means 40 for hinging the casing 10 include the axis O of rotation which is here determined by the pin connecting to one another, the first portion 36 and second portion 38.

Preferably, the first mobile portion 36 is integral with the inner part 24 of the cover 14 and the second fixed portion 38 is integral with the outer part 16 of the base 12.

Advantageously, the casing 10 includes a trim part 42 arranged on the means 40 for hinging between the cover 14 and the base 12, in particular intended to conceal them.

The trim part 42 cooperates with the first mobile portion 36 means 40 for hinging so as to arrange between them a space with the purpose of forming a passage 44.

The trim part 42 is connected to the first mobile portion 36 of the hinging means 40 by way of connection means 46 and 48 intended to cooperate together.

Figure 7:
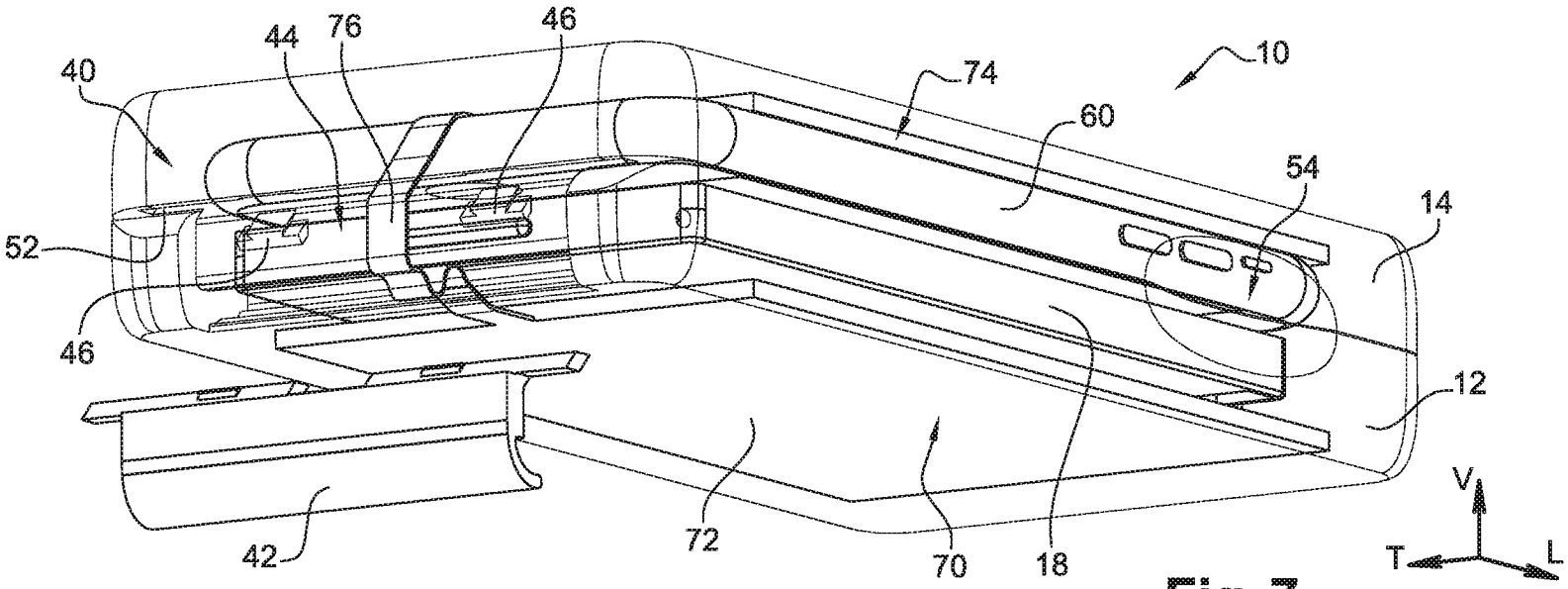
FIG. 7 is a perspective view that transparently shows the casing according to FIG. 1 and the trim part and which shows, at the level of the hinging means forming the hinge of the casing, the passage arranged for the ribbon connector connecting the two portions of the device for processing data.
Figure 8:
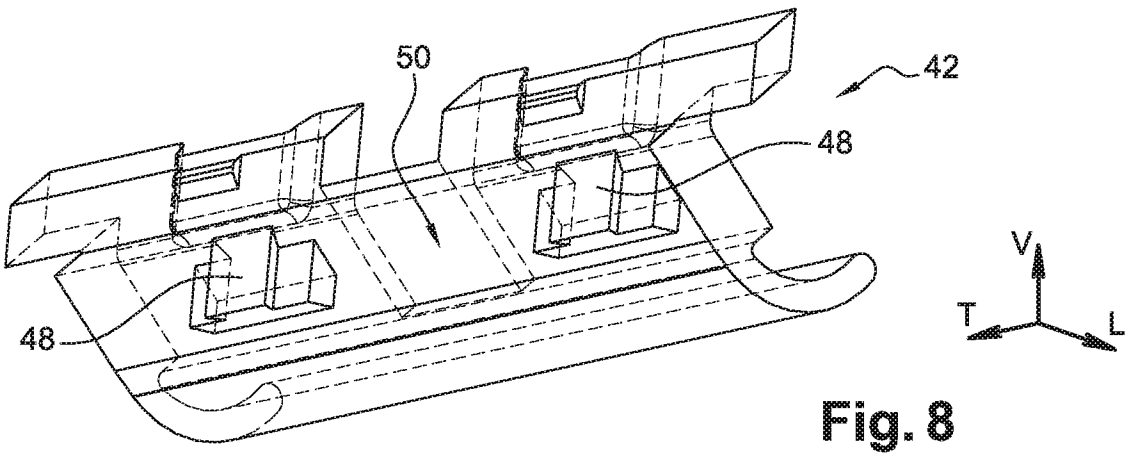
FIG. 8 is a perspective view that shows the trim part removed in FIG. 7 and which shows, in particular, the notch that contributes to providing the passage for the ribbon connector.

The trim part 42 is more particularly visible in FIG. 8 and reference will also be made to FIG. 7.

The connection means 46 and 48 include, for example, a pair of male elements 46 carried by the first portion 36 and a pair of female elements 48 which, having shapes that are complementary with those of the male elements 46, are provided in the trim part 42.

Preferably, the male elements 46 of the first mobile portion 36 have a dovetail shape which is more particularly visible in FIG. 7.

The pair of female elements 48 of the trim part 42 are more particularly visible in FIG. 8 which also shows a notch 50 arranged inside the part 42.

The notch 50 of the trim part 42 contributes to providing the passage 44 arranged on the hinging means 40 forming a hinge.

The inner part 24 of the cover 14 includes a slot 52 which is arranged below the first mobile portion 36 and which extends transversally.

The function of the passage 44 as well as the slot 52 will be described in more detail later.

Preferably, the casing 10 includes gripping means 54 to facilitate the opening of the casing. The gripping means 54 are, for example, formed by at least one indentation.

The indentation 54 is divided into two portions that are juxtaposed in the closed position of the cover 14, respectively one portion 53 carried out in the edge 17 of the outer part 16 of the base 12 and another portion 55 carried out in the edge 23 of the outer part 22 of the cover 14.

Advantageously, the casing 10 includes an indentation 54 on each side along the transversal direction, one on the left and the other on the right, so as to facilitate the gripping thereof, for example, by the thumb and the index finger of the user.

Advantageously, the casing 10 includes at least display means 56. The cover 14 is thus configured to receive at least such display means 56.

The display means 56 are intended to be arranged in the cover 14, more specifically in the cavity 26 formed between the outer part 22 and the inner part 23.

The display means 56 of the casing 10 include at least one screen which is advantageously a touch-sensitive screen.

Advantageously, the casing 10 includes at least means 58 for taking pictures, such as camera, which are capable of communicating with the display means 56.

Preferably, the display means 56 formed by the screen are removable with respect to the cover 14 of the casing 10.

Alternatively, the display means 56 formed by the screen are fastened to the cover 14, mounted permanently.

In such an alternative of the casing 10 that permanently integrates a screen 56, the hinging means 28 described hereinabove are advantageously removed and the fastening means 30 then function to fasten together the outer part 22 and the inner part 23 without necessarily the fastening obtained being reversible.

Thanks to the hinging means 28, the outer part 22 and the inner part 23 are likely to be moved with respect to one another from the closed position to the open position so as to access the cavity 26 to house therein or to extract therefrom at least the display means 56.

Advantageously, the at least one screen 56 forming the display means belongs to an electronic device 60, in particular a mobile telephone of the "smartphone" type or a tablet.

In the example, the cover 14 of the casing 10 is configured to receive a telephone 60. The telephone 60 shown in FIG. 1 is housed in the cavity 26 wherein it is held in place.

Advantageously, such a telephone 60 includes the at least one touch-sensitive screen 56 and the means 58 for taking pictures.

Figure 4:
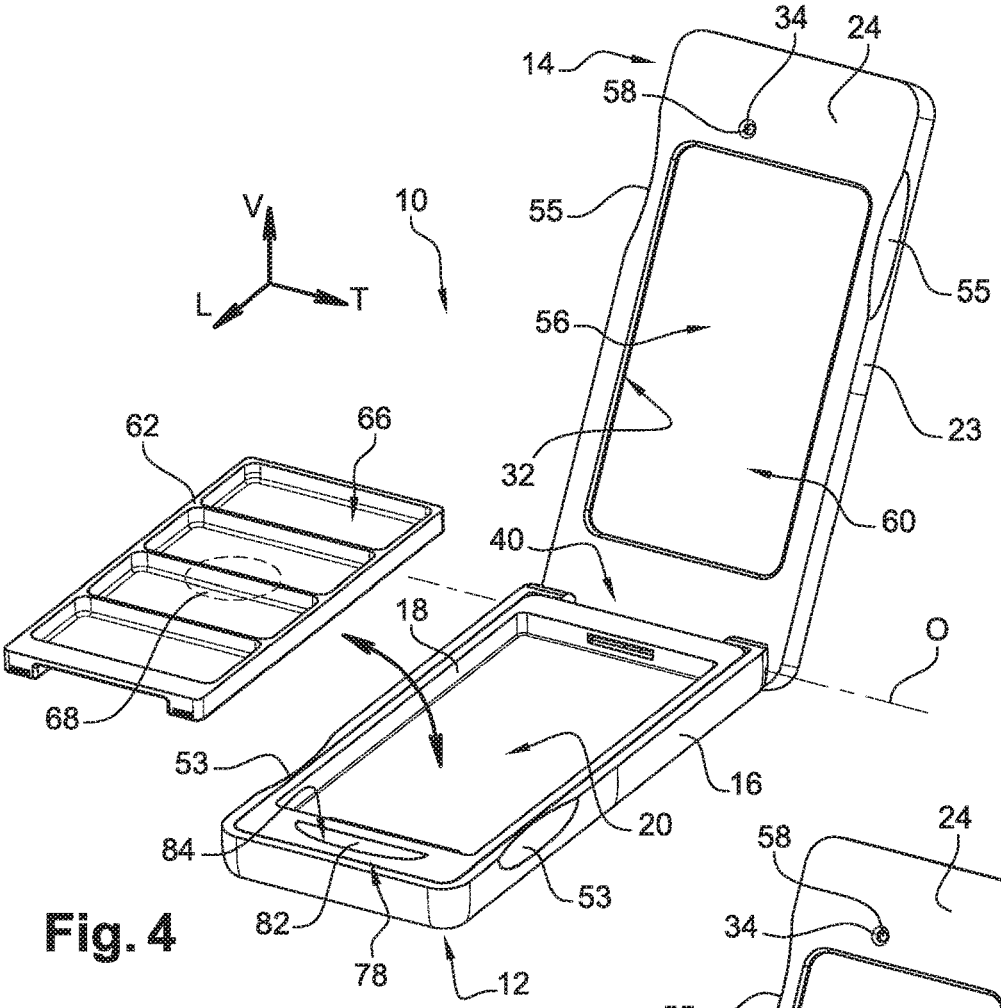
FIG. 4 is a perspective view that shows a casing according to FIG. 1 in the open position and which shows, before the mounting thereof in a housing associated with the base of the casing, means for supporting at least one cosmetic product that include the at least one data support.

In the open position of the casing 10 and such as shown in FIGS. 4 and 5, the screen 56 is visible and accessible through the window 32 of the inner part 24 of the cover 14.

The opening 34 is positioned on the inner part 24 of the cover 14 to be located in coincidence with the means 58 for taking pictures.

Thanks to the means 58 for taking pictures integrated into the cover 14, the screen 56 can be used as a mirror, in order, in particular, to make it possible for the user to apply make-up.

The casing 10 is intended to include means 62 for supporting at least one cosmetic product 64.

Advantageously, the support means 62 are removable in such a way that the means 62 are able to be freely changed by the user.

FIG. 1 and the following show a non-limiting example of such means 62 for supporting, overall having the shape of a plate.

In the example, the means 62 for supporting include four cups 66 intended to each receive a cosmetic product 64 which is shown in FIG. 1 by dots (in only one of the cups 66).

Alternatively, the means 62 for supporting include one single cup or at least one reservoir.

The support means 62 are configured to receive at least one cosmetic product 64 such that the structure of the support means 62 is suitable for the type of cosmetic product, in particular so as to be able to make it possible for the storage thereof.

In a non-limiting manner, this can be a cosmetic product 64 of the same type, such as for example a blush or a powder, but having different shades (or colours) in each one of the cups 66 so as to provide a make-up palette.

The support means 62 are intended to be mounted in the housing 20 of the intermediate part 18 of the base 12 of the casing 10.

Such as shown, in particular, in FIGS. 4 and 5, the support means 62 are removable, likely to be mounted in or extracted outside of the housing 20.

Preferably, the support means 62 are held in the position of use in the housing 20 by a nesting adjusted with the inner part 18.

Alternatively, the base 12 of the case 10 could include blocking means that intervene between the support means 62 and the base 12 in order to immobilise the support means 62 in the position of use shown in FIG. 5.

Advantageously, the means 62 for supporting the cosmetic product or products 64 are likely to be removed from the casing 10 by the user, in particular with the purpose of being changed or renewed.

The user can indeed wish to change the support means 62 for various reasons, for example to refill the casing 10 when at least one of the cosmetic products 64 present in the cups 66 of the support means 62 has been fully used.

Advantageously, the new support means 62 set in place including the cosmetic product or products 64 then forms a refill for the casing 10.

The user can also wish to change the support means 62 to simply use other types of cosmetic products 64, or also to be able to have other shades according to her needs.

Advantageously, the casing 10 can be marketed separately or with a set of several support means 62 in order to provide the user with a range of different shades, as well as individual refills to renew each one of the support means 62.

Advantageously, a dispenser is proposed wherein several means 62 for supporting can be stored when they are not used in the casing 10, all or at least one portion of these support means 62 having already been used or not.

According to a significant characteristic of the invention, the support means 62 include at least one data support 68.

Preferably, the at least one data support 68 is formed by an NFC tag (acronym for "Near Field Communication").

In the present description, the term "tag" is used in a broad and non-limiting sense, with this term encompassing for example here also those of "transponder", "chip" or "tag".

NFC technology is a short-range and high-frequency wireless communication technology, that makes it possible for information to be exchanged between various compatible means.

Alternatively, the at least one data support 68 is an RFID label (acronym for "Radio Frequency Identification").

Indeed, a wireless communication technology other than NFC technology could be used such as RFID technology or BLE technology (Bluetooth Low Energy).

Advantageously, the at least one data support 68 is integral with the means 62 for supporting including the cosmetic product or products 64.

Such as shown in the figures, the at least one data support 68 formed by the NFC tag is for example fastened underneath support means 62. The at least one data support 68 is, for example, fastened to the support means 62 by gluing or any other suitable means.

Advantageously, the at least one data support 68 and the support means 62 therefore form one single sub-assembly.

The at least one data support 68 includes, for example, one or more items of data which are associated with the at least one cosmetic product 64 that are contained in the interchangeable means 62 for supporting.

According to the invention, the casing 10 includes a device 70 for processing data that is at least capable of reading one or more items of data contained in the at least one data support 68 associated with the support means 62 when the support means 62 are mounted in the at least one housing 20, i.e. in the position of use.

Advantageously, the device 70 for processing data is of the contactless type, in particular capable of reading an NFC tag that form the at least one data support 68.

Advantageously, the device 70 for processing data operates without any supply of electrical energy, in particular no battery.

The device 70 for processing data includes at least one first portion 72 which is arranged in the base 12 and a second portion 74 which is arranged in the cover 14.

Advantageously, the first and second portions 72 and 74 of the device 70 for processing data are connected by at least one ribbon connector 76.

Preferably, the ribbon connector 76 is flexible or semi-rigid in order to be able to electrically connect the first portion 72 and the second portion 74 through the hinging means 40 of the casing 10.

Such as described hereinabove, the hinging means 40 are configured to have a passage 44 wherein is housed the ribbon connector 76, as is more particularly visible in FIG. 7.

The passage 44, as well as the trim part 42, makes it possible to fully conceal the ribbon connector 76 such that the ribbon connector 76 cannot be seen from the outside, as from the inside, of the casing 10.

The ribbon connector 76 is centrally arranged in the passage 44, i.e. transversally between the male elements 46 of the means for connecting with the trim part 42 which are integral with the first mobile portion 36 of the hinging means 40.

The ribbon connector 76 thus has a space ensuring that it will not be damaged, in particular during handling for closing and of opening the casing 10, thanks to the facing notch 50 that the trim part 42 contains.

Advantageously, the ribbon connector 76 is arranged inside the casing 10 so as to never be visible for the user which helps in obtaining an aesthetic casing 10.

The ribbon connector 76 passes through the transverse slot 52 of the inner part 24 of the cover 14 in order to be connected to the second portion 74 of the processing device 70.

Thanks to the various characteristics that have just been described, the ribbon connector 76 is preserved from any deterioration and this, while during the correct operation of the device 70 for processing data integrated into the casing 10.

Advantageously, the first portion 72 and the second portion 74 of the processing device 70 are flat, each overall having the shape of a plate.

Thanks to the low thickness thereof, the first portion 72 and the second portion 74 of the device 70 for processing data are respectively integrated into the casing 10 without affecting the general size thereof.

Figure 3:
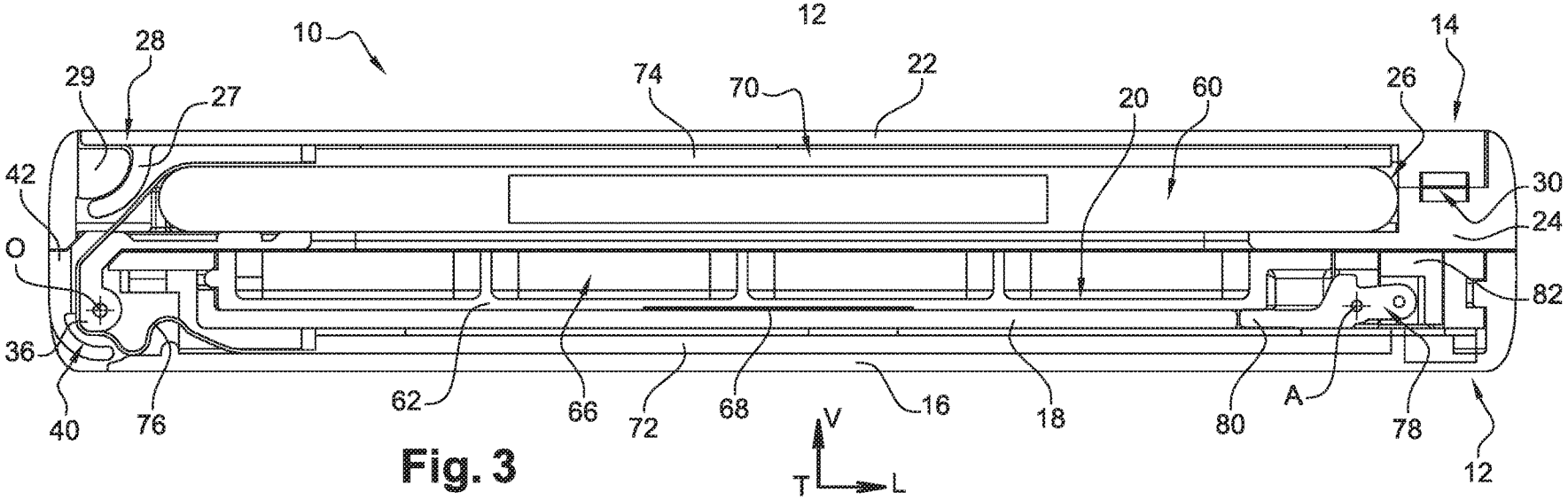
FIG. 3 is a cross-sectional view that shows the casing according to the cross-sectional plane III-III shown in FIG. 2 and which shows the arrangement of the device for processing data, display means and support means inside the base and the cover of a casing according to FIG. 1.
Figure 6:
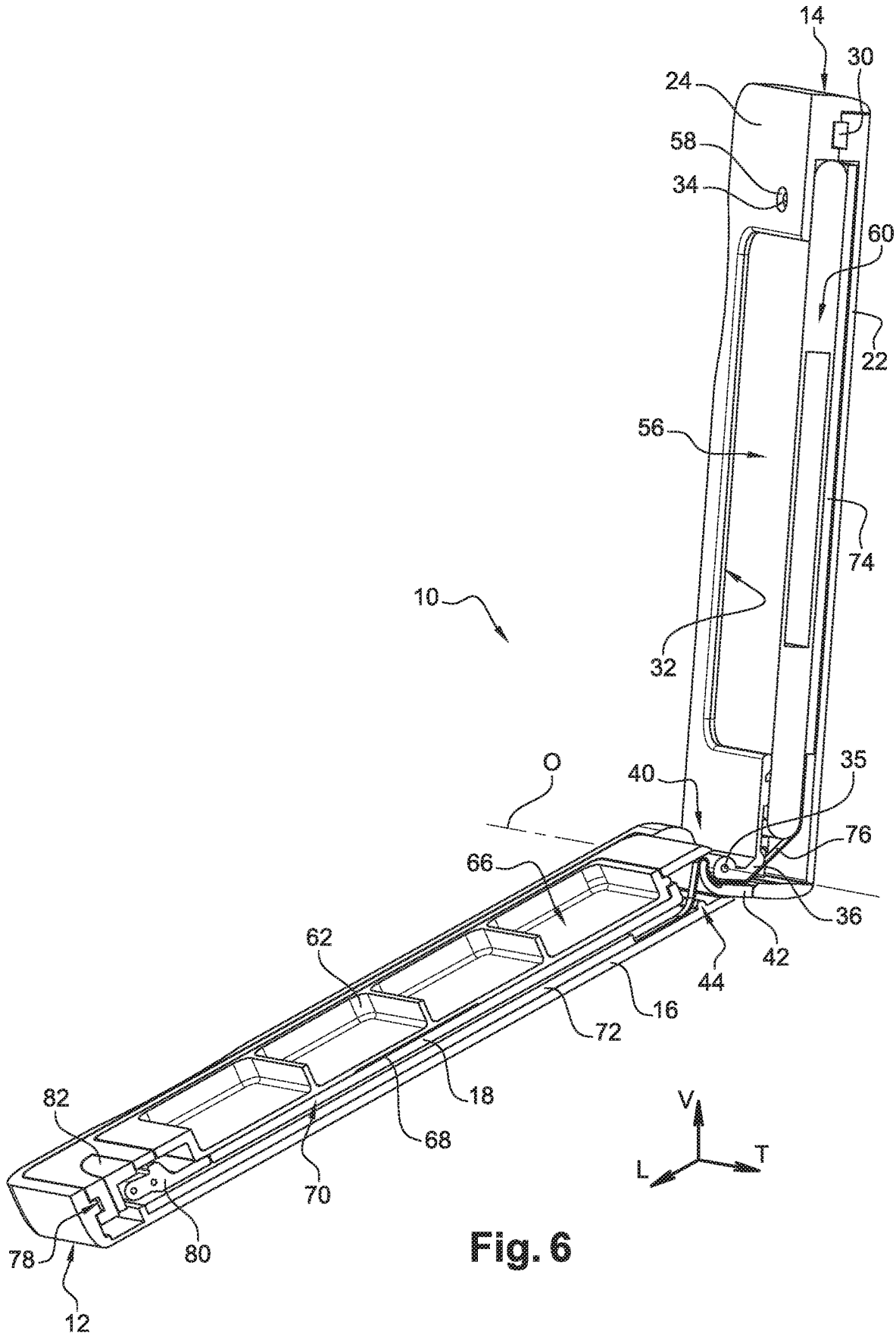
FIG. 6 is a cross-sectional view that shows the casing in the open position according to FIG. 5 and which shows the arrangement of the device for processing data, display means and support means inside the base and the cover of a casing according to FIG. 1.

Such as shown in the cross-sections of FIGS. 3 and 6, the first portion 72 is arranged between the outer part 16 of the base 12 and the intermediate part 18.

Advantageously, the first portion 72 extends below at least one portion of the housing 20 of the intermediate part 18 (here all of the housing 20) wherein the support means 62 in the position of use are mounted.

The first portion 72 thus arranged is able to at least read the at least one data support 68 integral with the support means 62, more generally is capable of communicating with it.

Similarly, the second portion 74 extends advantageously between the outer part 22 and the back of the display means 56, here of the telephone 60, i.e. on the side opposite the screen.

The first portion 72 of the device 70 for processing data is capable of communicating with the at least one data support 68 of the support means 62.

The second portion 74 of the device 70 for processing data is capable of communicating with means (not shown) for exchanging compatible data associated with the display means 56, that are preferably integrated into the telephone 60 and that use the NFC technology.

In the position of use of the support means 62 of the at least one cosmetic product 64 and as can be seen in FIGS. 3 and 5, the at least one data support 68 is arranged above and at a very short distance from the first portion 72 of the device 70 for processing data.

Indeed, the space that separates the data support 68 and the first portion 72 of the device 70 is around a few millimetres, corresponding here to the thickness of the wall of the bottom of the inner part 18 of the base 12.

The first portion 72 is at least capable of reading the item of items of data contained in the data support 68.

Preferably, the operation of reading the data support 68 is carried out automatically by the first portion 72 of the device 70 for processing, for example, iteratively.

Advantageously, the first portion 72 of the device 70 for processing performs at least one reading operation after each change in the support means 62 containing the cosmetic product or products 64.

Preferably, the first portion 72 of the processing device 70 is also able to write one or more items of data in the data support 68.

Advantageously, the writing of at least one item of data in the data support 68 by the first portion 72 of the processing device 70 can make it possible to save therein data such as the date of the first use of the support means 62 of which is integral with the data support 68, or the assumed date of the first use of the cosmetic product or products 64.

Such data is then likely to be used in order to obtain information such as for example a frequency of use, etc. the item of data can be used to deliver new services to the user from suggesting products that correspond to those used most frequently to proposing the ordering of refill(s), etc.

To do this, the second portion 74 of the device 70 for processing is at least capable of transferring the item of items of data read by the first portion 72 to the means (not shown) for exchanging compatible data associated with the display means 56, which use for example the NFC technology are advantageously integrated here into the telephone 60.

The first portion 72, like the second portion 74 of the device 70 for processing data are arranged at a very short distance from the means with which each one is intended to communicate, respectively the at least one data support 68 integral with the support means 62 and at least the display means 56.

The NFC technology is in particular preferred due to the very short distance at which the data exchanges can be performed as a read and/or as a write in the casing 10.

Advantageously, the device 70 for processing data is perfectly integrated into the casing 10 and the first portion 72 as the second portion 74 cannot be seen by the user, regardless of the open or closed position of the casing 10.

Advantageously, the first portion 72 is protected by the intermediate part 18, in particular from dirt coming, for example, from the cosmetic product or products 64.

To facilitate the removal of the support means 62 outside of the housing 20 and therefore the changing thereof, the base 12 of the casing 10 advantageously includes means 78 for assisting with the extraction.

The assisting means 78 include at least one member 80 for extracting which, forming a lever, is intended to selectively cooperate with the support means 62.

The at least one extraction member 80 is movably mounted between at least one rest position and an extraction position wherein the extraction member 80 cooperates with the support means 62 in order to lift at least one portion thereof outside of the housing 20 so as to facilitate the removal therefrom, and this with the gripping by the user.

In the example, the assisting means 78 are arranged longitudinally at the front of the casing 10, i.e. opposite the hinging means 40.

The assisting means 78 are advantageously integrated into the base 12 so as to preserve the general aesthetics of the casing 10.

The at least one extraction member 80 is for example pivotably mounted about a transversal axis A shown in FIG. 3, respectively between the rest position and the extraction position.

The at least one member 80 for extracting the assisting means 78 is manually controlled by way of a control member 82 in order to cause the movement thereof, here the pivoting, from the rest position to the extraction position.

The control member 82 is, for example, formed by a push-button which is made accessible by an opening 84 arranged for this purpose in the inner part 18 and with respect to the surface from which the member 82 is advantageously slightly protruding from.

The control member 82 is actuated by applying a thrust force to it, vertically downwards, the force being, for example, applied by the user using at least one of their fingers.

The control member 82 is thus guided to slide vertically towards the inside of the base 12 having a clearing for this purpose.

The control member 82 will thus act on the at least one member 80 for extracting to which it is linked in movement to cause the pivoting thereof about the axis A, from the rest position to the extraction position.

The movement of the extraction member 80 from the rest position to the extraction position is accompanied by a thrust force which is applied on the support means 62 so as to cause the lifting thereof.

Preferably, the at least one extraction member 80 (or the control member 82) is movably mounted against means of elastic return (not shown) which are capable of returning it automatically into at least one of the rest and extraction positions, advantageously towards the rest position.

Alternatively, the at least one extraction member 80 is returned to the rest position by the new support means 62 when they are introduced into the housing 20 of the base 12.

Advantageously, the casing 10 is likely to be electrically powered by a contactless energy transmission technology, for example by induction.

There are different contactless energy transmission solutions, mention shall be made by way of a non-limiting example of Qi™ (registered trademark).

Thanks to the use of such a contactless energy transmission technology, it is for example possible to recharge at least one power supply battery intended to supply with electricity the means 56 for displaying, in particular when the latter are mounted to remain in the cover 14.

In the embodiment example that has just been described, the at least one battery is, for example, formed by that of the telephone 60 of which the touch-sensitive screen is used as a means 56 for displaying the casing 10.

When the casing 10 includes a cover 14 which is designed to receive a telephone 60, the electrical charging can be carried out without it being necessarily required to remove it from the cavity 26.

Hereinafter, examples of use and advantages obtained with an interactive casing 10 carried out in accordance with the teachings of the invention will be described in a non-limiting manner.

The user who wants to use the interactive casing 10 will, in order to apply make-up for example, first proceed by opening it.

To do this, the user advantageously grips the cover 14 on the gripping means 54, here formed by the indentations, and manually applies—while still holding the base 12—a traction force on the cover 14 to cause the rotation of the cover 14, about the axis O of rotation of the hinging means 40, from the closed position to the open position.

In the example, the inclination of the cover 14 including the means 56 for displaying in the open position is freely determined by the user such that the cover 14 can angularly occupy, with respect to the base 12, more than one open position.

Preferably, the device 70 for processing data is in an active state when the casing 10 is in the open position and in a standby state when the casing 10 is in the closed position.

The device 70 for processing data and more specifically, the first portion 72 thus proceeds to read data contained in the tag 68 of the NFC type which is integral with support means 62 mounted in the housing 20.

The user can retain the support means 62 located in the position of use during the opening (alternatively the housing 20 could be empty) or decide to change it.

In case of a change in the means 62 for supporting cosmetic products 64, the user advantageously actuates the control member 82 of the means 78 for assisting with the extraction in order to cause the lifting of the front portion of the support means 62 so as to be able to easily grip it.

Advantageously, the display means 56 formed by the screen of the telephone 60 will then be able to deliver to the user, information in relation with the item or items of data contained in the tag 68 of the NFC type that is fastened to the support means 62 containing the cosmetic product or products 64.

By way of example, the information supplied by way of the screen 56 is in relation with the cosmetic product or products 64, it can in particular be recommendations for use of the cosmetic product or products or associated services, etc.

When the touch-sensitive screen 56 belongs to a telephone 60, many possibilities of interactive use are offered to the user, but also many advantages such as those mentioned hereinabove for the manufacturers and/or the sellers of cosmetic products.

The casing 10 provided with a telephone touch-sensitive screen 56 offers almost infinite possibilities for interactivity with the user.

By way of the touch-sensitive screen 56 and an application such as a tutorial integrated into the telephone 60, it is, for example, possible to deliver recommendations to assist the user in choosing a product with respect to a range of different cosmetic products, provide them with recommendations for applying the product, etc.

Advantageously, the casing 10 is likely to exchange data by way of a wireless connection, in particular Wi-Fi, for the purpose in particular of connecting to the internet.

The interactive casing 10 offers numerous advantages for a brand of cosmetic products by giving it the possibility of reinforcing the brand image thereof and the loyalty of the users of the products thereof.

Of course, the example of the casing 10 that has just been described is in no way limited and many alternative embodiments could be considered without leaving the scope of the invention.

In an alternative not shown, the casing 10 includes locking means that can hold the cover 14 in the closed position.

In an alternative not shown, the casing 10 includes a cover 14 including at least one intermediate part that forms an adapter in order to be able to receive different telephone models.

In an alternative not shown, the casing 10 includes at least one housing for the storage of at least one cosmetic product applicator, in particular for make-up.

The at least one housing for the applicator is for example arranged in the base 12 or in the cover 14 of the casing 10, or integrated into the means 62 for supporting.

In an alternative not shown, the casing 10 includes at least one orifice in order to make it possible for the connection of a cable, for example, in order to electrically power for the purpose of recharging a battery associated at least with the display means 56 that preferably belong to a telephone 60.

Preferably, the orifice intended to make it possible for the connecting of a cable such as an electric power cable is in particular accessible in the closed position of the casing 10.

It will have been understood that, the casing 10 is likely to be sold with or without display means 56 and with or without support means 62 at least one cosmetic product 64.

The casing 10 for a cosmetic product includes at least one base 12 and one cover 14 which are movably mounted with respect to each other between at least one closed position and an open position of the casing wherein means 62 for supporting at least one cosmetic product are accessible, the casing 10 being characterized in that the cover 14 includes at least means 56 for displaying, the base 12 includes at least one housing 20 wherein are mounted the means 62 for supporting and in that the casing 10 includes a device 70 for processing data of the contactless type that is at least capable of reading one or more items of data contained in at least one data support 68 integral with the means 62 for supporting.

Having thus described the invention of the present application in detail and by reference to embodiments thereof, it will be apparent that modifications and variations are possible without departing from the scope of the invention defined in the appended claims as follows:

What is claimed is:

1. A casing for a cosmetic product comprising at least one base and one cover which are movably mounted with respect to each other between at least one closed position and an open position of the casing wherein means for supporting at least one cosmetic product are accessible, wherein:

the cover is configured to receive at least display means, the base comprises at least one housing intended to comprise said support means, and the casing comprises a device for processing data of the contactless type that is at least capable of reading one or more items of data contained in at least one data support integral with said support means while said support means are mounted in said at least one housing, said device for processing data being able to communicate with at least the display means, wherein the device for processing data comprises at least one first portion which is arranged in the base and a second portion which is arranged in the cover, said first and second portions being electrically connected by at least one ribbon connector, the first portion extending at the back of the support means, the second portion extending at the back of the display means.

2. The casing according to claim 1, wherein said support means comprising said at least one data support are removable.

3. The casing according to claim 2, wherein the casing comprises means for assisting with the extraction in order to facilitate the removal of said interchangeable support means outside of the housing.

4. The casing according to claim 1, wherein hinging means are arranged between the cover and the base in order to form a hinge in order to be able to move them between said closed and open positions, wherein the hinging means are configured to have a passage intended for said ribbon connector connecting the first portion and the second portion of the device for processing data.

5. The casing according to claim 1, wherein the first portion of the device for processing data is capable of communicating with said at least one data support that are contained in the support means and the second portion of the device for processing data is able to communicate with at least the display means.

6. The casing according to claim 1, wherein said at least one data support is a tag of the NFC type.

7. The casing according to claim 1, wherein the casing comprises display means which are constantly integral with the cover or removable with respect to said cover.

8. The casing according to claim 7, wherein the display means comprises at least one screen belonging to a mobile telephone.

* * * * *